United States Patent [19]

Forbus, Jr. et al.

[11] Patent Number: 4,906,799

[45] Date of Patent: Mar. 6, 1990

[54] PROCESS FOR THE PRODUCTION OF REDUCED VISCOSITY HIGH VI HYDROCARBON LUBRICANT

[75] Inventors: Thomas R. Forbus, Jr., Newtown, Pa.; Andrew Jackson, Princeton, N.J.

[73] Assignee: Mobil Oil Corporation, New York, N.Y.

[21] Appl. No.: 266,041

[22] Filed: Nov. 2, 1988

[51] Int. Cl.[4] ..... C07C 1/00; C07C 4/02

[52] U.S. Cl. ..... 585/241; 585/329; 585/648

[58] Field of Search ..... 585/241, 648, 329

[56] References Cited

U.S. PATENT DOCUMENTS

| | | | |
|---|---|---|---|
| 3,441,628 | 4/1969 | Ratzsch et al. | 585/241 |
| 3,705,926 | 12/1972 | Rumpf et al. | 585/648 |
| 4,214,110 | 7/1980 | Moroe | 585/241 |
| 4,327,237 | 4/1982 | Imparato et al. et al. | 585/648 |
| 4,552,621 | 11/1985 | Lyekhevich et al. | 585/241 |
| 4,579,986 | 4/1986 | Sie | 585/648 |
| 4,692,862 | 9/1972 | Staud et al. | 585/539 |
| 4,827,073 | 5/1989 | Wu | 585/10 |

*Primary Examiner*—Curtis R. Davis

*Attorney, Agent, or Firm*—Alexander J. McKillop; Charles J. Speciale; Malcolm D. Keen

[57] ABSTRACT

A process is disclosed for the production of low viscosity, high viscosity index liquid lubricant in high yield by the thermally-induced cleavage or pyrolysis of higher molecular weight oligomers of 1-alkenes. Further, it has been discovered that the reduced viscosity lubricants produced by pyrolysis of higher viscosity 1-alkene oligomers retain the superior characteristics of high viscosity index and low pour point of the starting material.

The process comprises contacting $C_6$–$C_{20}$ 1-alkene feedstock with reduced valence state chromium oxide catalyst on porous silica support under oligomerizing conditions in an oligomerization zone whereby viscosity, high VI liquid hydrocarbon lubricant is produced having branch ratio less than 0.19 and pour point below —15° C.; passing said high viscosity liquid lubricant through a pyrolysis zone under pyrolyzing conditions; separating reduced viscosity liquid hydrocarbon lubricant having high VI and low pour point.

17 Claims, 1 Drawing Sheet

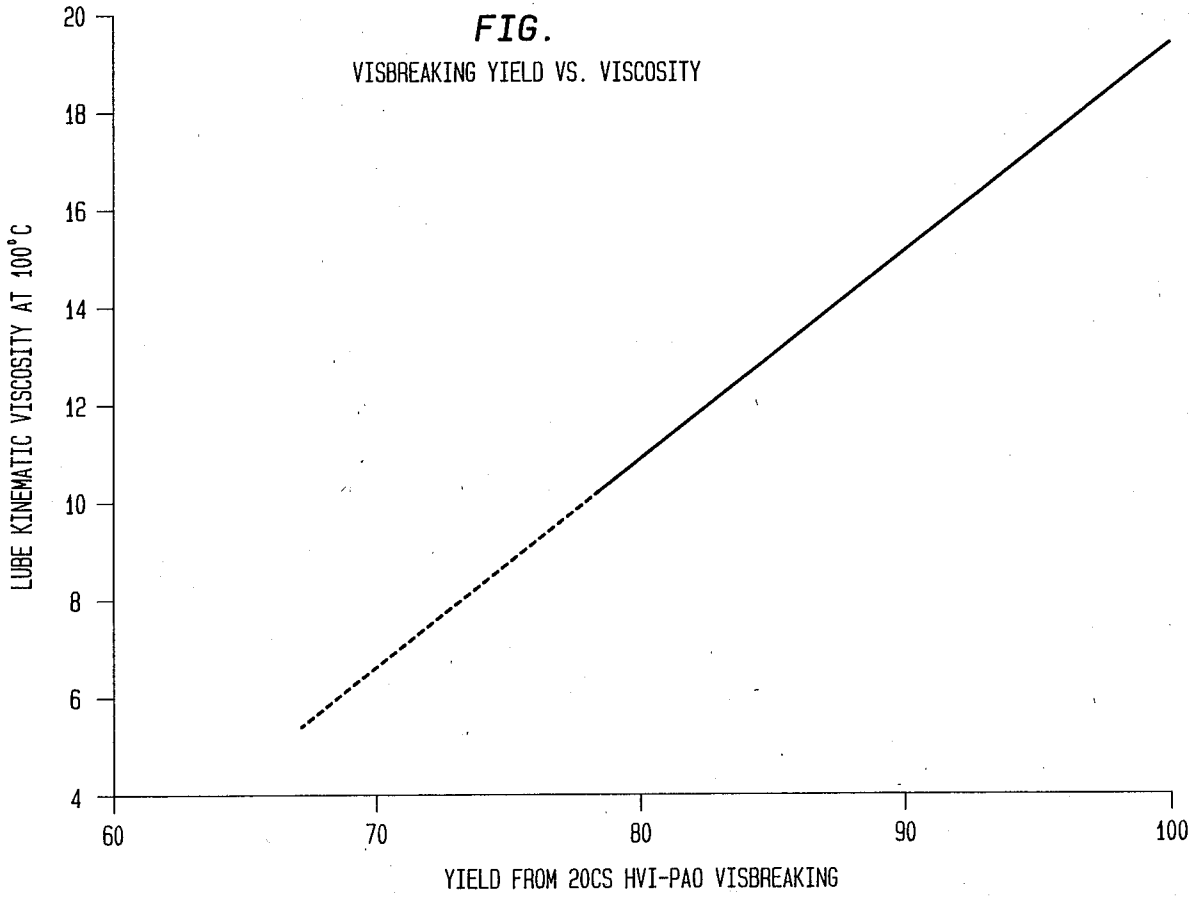
FIG.
VISBREAKING YIELD VS. VISCOSITY

PROCESS FOR THE PRODUCTION OF REDUCED VISCOSITY HIGH VI HYDROCARBON LUBRICANT

This invention relates to novel processes for the production of lubricant compositions. The invention, more particularly, relates to novel synthetic lubricant compositions prepared from alpha-olefins, or 1-alkenes. The invention specifically relates to the production of novel low viscosity synthetic lubricant compositions from 1-alkene oligomers by thermally induced viscosity reduction to produce lubricants exhibiting superior viscosity indices and other improved characteristics essential to useful lubricating oils.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index, while also showing lubricity, thermal and oxidative stability and pour point equal to or better than mineral oil. These new synthetic lubricants lower friction and hence increase mechanical efficiency across the full spectrum of mechanical loads in all types of gear boxes and do so over a wider range of operating conditions than mineral oil lubricants. In the prior art, oligomers of 1-alkenes from $C_6$ to $C_{20}$ have been prepared with commercially useful synthetic lubricants from 1-decene oligomerization yielding a distinctly superior lubricant product via either cationic or Ziegler catalyzed polymerization.

One characteristic of the molecular structure of 1-alkene oligomers that has been found to correlate very well with improved lubricant properties in commercial synthetic lubricants is the ratio of methyl to methylene groups in the oligomer. The ratio is called the branch ratio and is calculated from infra red data as discussed in "Standard Hydrocarbons of High Molecular Weight", *Analytical Chemistry,* Vol.25, no.10, p.1466 (1953). Viscosity index has been found to increase with lower branch ratio. Heretofore, oligomeric liquid lubricants exhibiting very low branch ratios have not been synthesized from 1-alkenes. For instance, oligomers prepared from 1-decene by either cationic polymerization or Ziegler catalyst polymerization have branch ratios of greater than 0.20. Shubkin, *Ind. Eng.-Chem. Prod. Res. Dev.* 1980, 19, 15–19, provides an explanation for the apparently limiting value for branch ratio based on a cationic polymerization reaction mechanism involving rearrangement to produce branching. Other explanations suggest isomerization of the olefinic group in the one position to produce an internal olefin as the cause for branching. Whether by rearrangement, isomerization or a yet to be elucidated mechanism it is clear that in the art of 1-alkene oligomerization to produce synthetic lubricants as practiced to-date excessive branching occurs and constrains the limits of achievable lubricant properties, particularly with respect to viscosity index. Obviously, increased branching increases the number of isomers in the oligomer mixture, orienting the composition away from the structure which would be preferred from a consideration of the concepts discussed above.

Recently, novel lubricant compositions (referred to herein as HVI-PAO) comprising polyalpha-olefins and methods for their preparation employing as catalyst reduced chromium on a silica support have been disclosed in U.S. patent applications Ser. No. 210,434, now U.S. Pat. No. 4,827,073, and 210,435, now U.S. Pat. No. 4,827,064 filed June 23, 1988, incorporated herein by reference. These novel lubricants exhibit high viscosity indices with low pour point. The compositions are characterized by a uniform molecular structure with low branch ratios comprising $C_{30}$–$C_{1300}$ hydrocarbons with a branch ratio of less than 0.19. High yields are achieved in the oligomerization process for novel lubricant oligomers with viscosities above 20 cS at 100° C. However, to produce lubricant with viscosity between 2 and 20 cS directly from the oligomerization of 1-alkene, high oligomerization temperatures are required. This results in both earlier catalyst deactivation and an increase in the yield of those oligomeric species, such as dimers of 1-alkenes, whose molecular weight is too low for lubricant use. Accordingly, the desirable, lubricant range low viscosity oligomer fraction is produced in relatively low yield and shortened catalyst life, compromising the economic viability of the direct synthesis route for low viscosity HVI-PAO product.

It is an object of the present invention to provide a method for the preparation of low viscosity range HVI-PAO in high yield.

It is another object of the present invention to provide a method for the preparation of low viscosity range HVI-PAO in high yield while retaining the high viscosity index and pour point characteristics of the novel oligomer.

Yet another object of the present invention is to prepare low viscosity HVI-PAO from high viscosity HVI-PAO.

SUMMARY OF THE INVENTION

It has been discovered that low viscosity HVI-PAO can be prepared in high yield by the thermally-induced cleavage or pyrolysis of higher molecular weight HVI-PAO oligomers. Further, it has been discovered that the reduced viscosity HVI-PAO produced by pyrolysis of higher viscosity HVI-PAO retains the superior characteristics of high viscosity index and low pour point of the starting material.

More particularly, a process has been discovered for the production of high viscosity index, low pour point, low viscosity liquid hydrocarbon lubricant, comprising:

contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratio less than 0.19 and pour point below −15° C.;

passing said high viscosity liquid lubricant through a pyrolysis zone under pyrolyzing conditions;

separating reduced viscosity liquid hydrocarbon lubricant having high VI and low pour point.

The starting high viscosity, high VI oligomer comprises the unsaturated product of the reduced chromium on silica catalyzed oligomerization of alpha olefins or 1-alkene.

DESCRIPTION OF THE FIGURE

The figure is a plot and extrapolation of lube viscosity versus yield for visbreaking of 20 cS HVI-PAO.

DETAILED DESCRIPTION OF THE INVENTION

In the following description, unless otherwise stated, all references to HVI-PAO oligomers or lubricants refer to unhydrogenated or unsaturated oligomers and lubricants. In keeping with the practice well known to those skilled in the art of lubricant production, following oligomerization or viscosity reduction, the products are typically hydrogenated to convert to stable lube products. As oligomerized, HVI-PAO oligomers are mixtures of dialkyl vinylidenic and 1,2 dialkyl or trialkyl mono-olefins.

The new class of alpha-olefin oligomers used as starting material for thermally-induced viscosity reduction, or visbreaking, to low viscosity lubricants in the present invention are prepared by oligomerization reactions in which a major proportion of the double bonds of the alpha-olefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area isbeneficial for supporting a large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or H2 or metal alkyl containing compounds. Alternatively, the Group VIB metal may be applied to the substrate in reduced form, such as CrII compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° C. for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. The product oligomers also have atactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The branch ratios defined as the ratios of $CH_3$ groups to $CH_2$ groups in the lube oil are calculated from the weight fractions of methyl groups obtained by infrared methods, published in *Analytical Chemistry,* Vol. 25, No. 10, p. 1466 (1953).

$$\text{Branch ratio} = \frac{\text{wt fraction of methyl group}}{1 - (\text{wt fraction of methyl group})}$$

It has been found that the process described herein to produce the novel HVI-PAO oligomers can be controlled to yield oligomers having weight average molecular weight between 300 and 45,000 and number average molecular weight between 300 and 18,000. Measured in carbon numbers, molecular weights range from $C_{30}$ to $C_{1300}$ and viscosity up to 750cs at 100° C., with a preferred range of $C_{30}$ to $C_{1000}$ and a viscosity of up to 500cs at 100° C. Molecular weight distributions (MWD), defined as the ratio of weight average molecular to number average molecular weight, range from 1.00 to 5, with a preferred range of 1.01 to 3 and a more preferred MWD of about 1.05 to 2.5. Compared to conventional PAO derived from $BF_3$ or $AlCl_3$ catalyzed polymerization of 1-alkene, HVI-PAO of the present invention has been found to have a higher proportion of higher molecular weight polymer molecules in the product. Viscosities of the novel HVI-PAO oligomers measured at 100° C. range from 3 cS to 5000 cS.

The following examples show the preparation of the HVI-PAO starting material used in the present invention. They are presented merely for illustration purposes and are not intended to limit the scope of the present invention.

EXAMPLE 1

Catalyst Preparation and activation Procedure 1.9 grams of chromium (II) acetate ($Cr_2(OCOCH_3)_4 2H_2O$)(5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

The catalyst prepared in Example 1 (3.2 g) is packed in a ⅜" stainless steel tubular reactor inside an $N_2$ blanketed dry box. The reactor under $N_2$ atmosphere is then heated to 150° C. by a single-zone Lindberg furnace. Prepurified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| T.O.S., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE 3

Similar to Example 2, a fresh catalyst sample is charged into the reactor and 1-hexene is pumped to the reactor at 1 atm and 10 cc per hour. As shown below, a lube of high viscosities and high VI's is obtained. These runs show that at different reaction conditions, a lube product of high viscosities can be obtained.

| Sample | A | B |
|---|---|---|
| T.O.S., hrs. | 20 | 44 |
| Temp., °C. | 100 | 50 |
| Lube Yield, % | 8.2 | 8.0 |
| Viscosities, cS at | | |
| 40° C. | 13170 | 19011 |
| 100° C. | 620 | 1048 |
| VI | 217 | 263 |

EXAMPLE 4

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 5

As in Example 4, purified 1-decene is pumped through the reactor at 250 to 320 psi. The product is collected periodically and stripped of light products boiling points below 650° F. High quality lubes with high VI are obtained (see following table).

| Reaction Temp. °C. | WHSV g/g/hr | Lube Product Properties V at 40° C. | V at 100° C. | VI |
|---|---|---|---|---|
| 120 | 2.5 | 1555.4 cs | 157.6 cs | 217 |
| 135 | 0.6 | 389.4 | 53.0 | 202 |
| 150 | 1.2 | 266.8 | 39.2 | 185 |
| 166 | 0.6 | 67.7 | 12.3 | 181 |
| 197 | 0.5 | 21.6 | 5.1 | 172 |

Olefins suitable for use as starting material to prepare HVI-PAO used as starting material in the invention include those olefins containing from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha olefinic as for example 1-heptene to 1-hexadecene and more preferably 1-octene to 1-tetradecene, or mixtures of such olefins.

Direct synthesis of low viscosity fluids from alpha-olefins with supported metal oxide catalysts generally suffers from low yield of trimer and higher poly-1-olefins due to the characteristic molecular weight distribution of the oligomers produced by this type of catalysis. Specifically, in the production of low viscosity poly-1-olefin fluids by supported metal oxide catalysis, large amounts of dimer can be formed which must be removed from the remainder of the liquid oligomer products if these fluids are to have the desirable volatility and pour point characteristics required of most liquid lubricant basestocks and blended lubricants. Production of substantial amounts of dimer with the trimer and higher oligomer products naturally reduces the amount of liquid products appropriate for lubricant basestocks.

In general poly-1-olefin fluids, consisting of trimer and higher oligomers, with kinematic viscosities of 20 cS at 100° C. can be produced by direct synthesis in a minimum of 90% yield based upon the starting 1-olefins feed. Production of lower viscosity homologues results in lower yield because of increased dimer product. This invention improves the overall yield of trimer and higher oligomer products based upon amount of starting olefin by taking 20 cS (at 100° C.) fluids, synthesized by the method described above and obtainable in high yields, and thermally cracking these fluids to lower viscosity homologous fluids.

Thermally-induced molecular weight reduction of predominantly 1,2-enchained poly-1-olefins produced from oligomerization/polymerization of alpha-olefins with supported metal oxide catalysts can give good yields of lower viscosity fluids, better than is obtainable by direct synthesis of these viscosities of these fluids. The fluids produced by thermal degradation process retain their high viscosity indices and low pour points which are directly comparable to directly synthesized fluids of comparable viscosity grade.

A 5.6 cS equivalent HVI-PAO basestock can be produced in 60% overall yield from 1-decene by visbreaking 20 cS assynthesized basestock. This is greater than the theoretical maximum yield of 50% of this viscosity grade based upon Shultz-Flory distribution prediction which does not account for the severe aging rate of the chromium-on-silica catalyst at the high temperature (200° C.) necessary to produce low viscosity grades. Therefore visbreaking can be the most economical method of producing low viscosity grades of HVI-PAO.

Although better than 90% lube yields are obtainable in the synthesis of HVI-PAO basestocks of 20 cS and greater, attempts to obtain basestocks of lower viscosity (~10 cS) suffer from production of greater amounts of non-lube range dimers and from rapid catalyst deactivation at the higher temperature needed for low viscosity. The overall yield from 1-decene to lube is limited since the dimers, once produced and off the catalytic site, are unreactive in this process.

EXAMPLE

Visbreaking is accomplished in a unit which consists of b 10'×0.25" stainless steel tube coiled in a fluidized sand bath. In this unit 20cS, 165 VI as-synthesized HVI-PAO basestock is continuously pumped at a specific flow rate to obtain an average residence time in the reactor tube at the reaction temperature. A 50psi back pressure, generated by a back-pressure regulator, is imposed at the product exit. The products from the visbreaker are distilled to remove the lighter-than-lube products and yields determined based upon total mass balance. The still bottoms are hydrogenated to give the finished basestocks. Hydrogenations are done in stainless steel autoclaves at 200° C., 600 psia $H_2$ until the uptake of hydrogen, as measured by closed-system pressure drop, ceases.

The visbreaking conditions, the lube yields and hydrogenated lube product properties are contained in the Table 1.

TABLE 1

Visbreaking Results for 20 cS HVI-PAO

| Product | R × T °C. | Time | Yield | CS @ 100° C. | VI | Pour Pt. °C. |
|---|---|---|---|---|---|---|
| A | 373 | 0.56 hr | 91% | 16.0 | 161 | −51 |
| B | 385 | 0.54 hr | 89% | 13.8 | 162 | −50 |
| C | 393 | 0.63 hr | 80% | 11.9 | 156 | −48 |
| D | 402 | 0.56 hr | 78% | 10.3 | 160 | −51 |
| E | 357 | 16.7 hr | 81% | 11.0 | 157 | −50 |

As expected the yields of visbroken HVI-PAO basestocks diminish with higher temperatures at constant residence time and final product viscosities. The VIs of the hydrogenated products are typical of those of hydrogenated HVI-PAO basestocks of the same viscosity grade from direct synthesis, as are the pour points.

A rough linear correlation can be made regarding visbreaking lube yield relative to hydrogenated product viscosity which is shown in FIG. 1. From linear extrapolation of this data, a low viscosity 5.6 cS equivalent HVI-PAO basestock yield of approximately 67% is predicted from 20 cS starting as-synthesized HVI-PAO. Based upon 90% synthesis yield of the 20 cS HVI-PAO, this gives an overall lube yield from 1-decene of 60% Based upon product oligomer distribution as calculated from Shultz-Flory equations, a 50% maximum yield of 5.6 cS basestock is predicted from direct synthesis process. This calculation, however, does not take into account the high aging rate of the chromium-on-silica catalyst at the temperature ( 200° C.) needed for producing this HVI-PAO viscosity grade which severely limits the utility of the direct synthesis process for producing low viscosity basestocks. In contrast to this, the yields of intermediate low viscosity grades of HVI-PAO (10-20 cS) can be most economically produced by direct synthesis.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for the production in high yield of low viscosity hydrocarbon lubricant having branch ratio below 0.19 and pour point below −25° C. from higher viscosity liquid hydrocarbon lubricant feedstock, comprising:

subjecting said liquid hydrocarbon lubricant feedstock to pyrolysis conditions in a pyrolyzing zone, said feedstock having a viscosity index greater than 130 and comprising the product of the oligomerization of $C_6$ to $C_{20}$ alpha-olefin feedstock, or mixtures thereof, under oligomerization conditions in contact with a reduced valence state Group VIB metal catalyst on porous support; and separating reduced viscosity, high VI liquid lubricant homologues of said lubricant feedstock in high yield.

2. The process of claim 1 wherein said pyrolyzing conditions comprise temperature between 300° and 500° C. and feedstock residence time between 0.1 and 20 hours.

3. The process of claim 1 wherein said pyrolyzing conditions comprise temperature between 350° and 450° C. and feedstock residence time between 0.25 and 2 hours.

4. The process of claim 1 wherein said feedstock viscosity is greater than 20 cS at 100° C.

5. The process of claim 1 wherein said homologues comprise liquid lubricant having a viscosity between 1 and 19 cS at 100° C. and viscosity index greater than 130.

6. The process of claim 1 wherein said homologues have a viscosity at 100° C. between 2 and 7cS and VI between 130 and 280.

7. The process of claim 1 wherein said feedstock comprises a liquid lubricant composition comprising $C_{30-C13_{00}}$ hydrocarbons, said composition having a branch ratio of less than 0.19, weight average molecular weight between 600 and 45,000, number average molecular weight between 600 and 18,000, molecular weight distribution between 1 and 5 and pour point below −15° C.

8. The process of claim 1 wherein said oligomerization conditions comprise temperature between 90° and 250° C. and feedstock to catalyst weight ratio between 10:1 and 300:1; said catalyst comprises CO reduced $CrO_3$ and said support comprises silica having a pore size of at least 40 Angstroms.

9. The process of claim 1 wherein said alphaolefin is selected from 1-octene, 1-decene, 1-dodecene, and mixtures thereof.

10. The process of claim 1 wherein said olefin is 1-decene.

11. A process for the production of high viscosity index, low pour point, low viscosity liquid hydrocarbon lubricant, comprising:

contacting $C_6$–$C_{20}$ 1-alkene feedstock with reduced valence, state chromium oxide catalyst on porous silica support under oligomerizing conditions in an oligomerization zone whereby high viscosity, high VI liquid hydrocarbon lubricant is produced having branch ratio less than 0.19 and pour point below −15° C.;

passing said high viscosity liquid lubricant through a pyrolysis zone under pyrolyzing conditions;

separating reduced viscosity liquid hydrocarbon lubricant having high VI and low pour point.

12. The process of claim 11 wherein said high viscosity liquid lubricant viscosity is greater than 20 cS at 100° C.; said reduced viscosity liquid lubricant viscosity is between 1 and 19 cS at 100° C., VI is greater than 130 and pour point is below −15° C.

13. The process of claim 11 wherein said pyrolyzing conditions comprise temperature between 300° and 500° C. and feedstock residence time between 0.1 and 20 hours.

14. The process of claim 11 wherein said pyrolyzing conditions comprise temperature between 350° and 450° C. and feedstock residence time between 0.25 and 2 hours.

15. The process of claim 11 wherein said oligomerization conditions comprise temperature between 90° and 250° C. and feedstock to catalyst weight ratio between 10:1 and 300:1; said catalyst comprises CO reduced $CrO_3$ and said support comprises silica having a pore size of at least 40 Angstroms.

16. The process of claim 11 wherein said 1-alkene is selected from 1-octene, 1-decene, 1-dodecene, and mixtures thereof.

17. The process of claim 11 wherein said 1-alkene is 1-decene.

* * * * *